United States Patent [19]

Hargis

[11] 4,119,504

[45] Oct. 10, 1978

[54] NON-WETTABLE BARRIER TO PREVENT CONDUCTION OF ELECTRICAL CURRENT BY MOLTEN SALT FILM

[75] Inventor: Robert L. Hargis, Palestine, Tex.

[73] Assignee: Aluminum Company of America, Pittsburgh, Pa.

[21] Appl. No.: 797,775

[22] Filed: May 17, 1977

[51] Int. Cl.[2] ..... C25C 3/00; C25C 3/10

[52] U.S. Cl. ..... 204/64 R; 204/245; 204/279

[58] Field of Search ..... 174/85, 31.5 C; 204/64 R, 243 R–247, 302, 279

[56] References Cited

U.S. PATENT DOCUMENTS

| | | | |
|---|---|---|---|
| 3,595,983 | 7/1971 | Muller et al. | 174/31.5 |
| 3,729,397 | 4/1973 | Goldsmith et al. | 204/64 R |
| 3,893,899 | 7/1975 | Dell | 204/245 X |

*Primary Examiner*—John H. Mack
*Assistant Examiner*—D. R. Valentine
*Attorney, Agent, or Firm*—Daniel A. Sullivan, Jr.

[57] ABSTRACT

A method of preventing the conduction of electricity along a film of molten salt on a surface. An electrically insulating material which is not wet by the molten salt is interposed in the film. The material is in the form of a protrusion on the surface.

11 Claims, 1 Drawing Figure

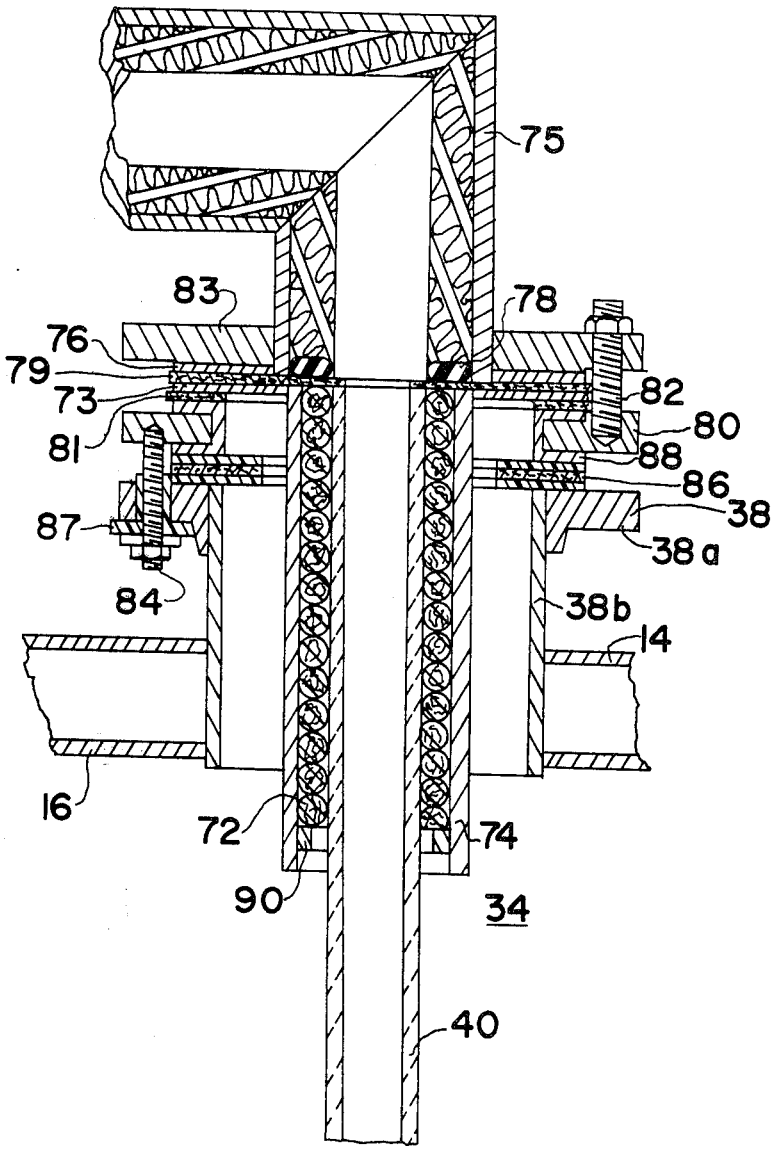
75
83
78
76
79
73
82
81
80
88
86
87
38
38a
84
38b
14
16
72
74
90
34
40

NON-WETTABLE BARRIER TO PREVENT CONDUCTION OF ELECTRICAL CURRENT BY MOLTEN SALT FILM

BACKGROUND OF THE INVENTION

The present invention relates to a technique for preventing the conduction of electrical current through a molten salt film. More particularly the present invention relates to a technique for preventing short-circuiting of a cell where electrolysis is being carried out in a molten salt bath.

A background patent showing the electrolysis of e.g. aluminum chloride in a molten salt bath is U.S. Pat. No. 3,893,899 of M. B. Dell et al., issued July 8, 1975, for "Electrolytic Cell for Metal Production". Such a cell is advantageously contained in a metal outer shell. Additionally it can be advantageous to tap such a cell by inserting into it a vacuum tapping tube by which molten metal collected in its sump is removed by suction. It is important in such and similar cases that the voltages actually being used for electrolysis not be able to run electrical current through the container or through the molten metal being tapped. If this occurs, energy is wasted which could otherwise be used for electrolysis. Additionally it is possible, for instance, for portions of the metal container to become red hot and thus dangerous if electrical leakage occurs.

British Pat. No. 687,758 of H. Grothe, published Feb. 18, 1953, shows a vacuum tapping tube 8 used in the tapping of molten aluminum product from a cell generating the aluminum by the electrolysis of aluminum chloride in a molten salt bath.

One of the problems inherent in operation of a cell as set forth in U.S. Pat. No. 3,893,899 is that portions of the molten salt bath and the compound being electrolyzed, e.g. aluminum chloride, can vaporize from the molten bath and condense as molten salt films on the interior lid areas of the cell. Thus a typical operating temperature in such a cell can be over 700° C, and vaporization can be considerable.

In general it has been the experience that it is usually a practical impossibility to keep the metal shell of a cell such as in U.S. Pat. No. 3,893,899 completely isolated. It usually tends to become anodic, i.e. it assumes the voltage of the anode in the process. During tapping, there is a continuous path of metal from the sump up through, for instance, the lid of the cell and this entire path is essentially at the cathode potential existing in the bottom of the cell. The presence of the molten salt films on the interior surfaces of the lid can lead to short-circuiting of the lid, at anode potential, to the metal being tapped, at cathode potential. This has happened in experiments with U.S. Pat. No. 3,893,899. Extremely high temperatures can result and of course electrical energy is wasted.

SUMMARY OF THE INVENTION

In view of the problems as outlined in the Background of the Invention it is an object of the present invention to provide a technique by which conductivity through a molten salt film can be prevented.

More particularly it is an object of the present invention to provide an improved technique of isolating the interior lid area of a cell for producing metal by electrolysis in a molten salt bath.

These as well as other objects which will become apparent in the discussion that follows are achieved according to the present invention by the method of preventing the conduction of electricity along a film of molten salt on a surface, which method includes interposing an electrically insulating material which is not wet by the molten salt, which material is in the form of a protrusion on the surface.

It is believed that those in the art have an adequate understanding of what is meant by non-wetting as regards the present invention. The idea is to create an effect like that displayed by water droplets on an oil surface, so that the continuity of the molten salt film is destroyed, this rendering the conduction of electrical current impossible. However, if a more precise definition is desired, it is noted that experts on the question of non-wetting state that a solid is not wet by a liquid when the contact angle between them is greater than 90°. Reference is made to the discussions of this in PHYSICAL CHEMISTRY OF SURFACES by Arthur W. Adamson, Interscience Publishers, New York (1960), at pages 264 to 280 and 355 to 359.

BRIEF DESCRIPTION OF THE DRAWING

The Figure is a sectional, elevational view of an embodiment of the present invention for tapping a cell.

DESCRIPTION OF THE PREFERRED EMBODIMENTS

With reference to the Figure, a preferred embodiment of the invention is described in conjunction with a tapping apparatus and the cell of the above-mentioned U.S. Pat. No. 3,893,899. With reference to the FIG. 1 of that patent, lid 9 of that patent corresponds to lid 16 in the present Figure, while port 10 there corresponds to port 38 here. The cell partially illustrated here, however, has been modified with respect to that shown in U.S. Pat. No. 3,893,899 to the extent that water cooling is provided on the top of lid 16 here and the refractory roof 8 of that patent has been eliminated here. Thus, cooling jacket 14 covers the lid 16 of the cell. And, lid 16 is exposed directly to chlorine and salt vapors and is made of a suitably chlorine resistant metal such as the alloy nominally containing 80% Ni, 15% Cr, and 5% Fe and sold under the trademark Inconel. Another suitable metal for lid 16 is 100% Ni, e.g. Nickel 200. All water pipes running to and from the cooling jacket are provided with rubber hose electrical breaks, so that electrical current cannot move to or from the cell along the otherwise metallic pipes.

The cell cavity also includes a bath reservoir 34 (corresponding to reservoir 7 in U.S. Pat. No. 3,893,899) in its upper zone. The tapping port 38 provides an orifice extending through the lid 16 into bath reservoir 34 for insertion of the vacuum tapping tube 40 forming part of the present invention. Port 38 is made of nickel or the above-mentioned alloy sold under the trademark Inconel.

Port 38 is, in this embodiment, constructed of a flange section 38*a* and pipe section 38*b*. As indicated above, port 38 provides an orifice extending from the exterior of jacket 14 into the bath reservoir 34 in the interior of the cell. Disposed within this orifice is vacuum tapping tube 40 of e.g. quartz, surrounded by asbestos rope packing 72 in packing tube 74.

A tapping snout 75, internally insulated as indicated schematically, with an end ring 78 of refractory ceramic material, and equipped with a flange 76, fits over gasket 79 onto the flange 73 of packing tube 74 and is fastened to ring 80 by bolts 82 (only one being shown for ease of illustration) passing through hold-down collar 83. A gasket 81 is interposed between flange 73 and ring 80. The ring 80 is secured to tapping port 38 by bolts 84 (only one being shown for ease of illustration) with the interposition of gasket 86. The bolts 84 are sealed in electrically insulating plastic bushing/washer combinations 87, of e.g. a thermoset plastic material, in order to better electrically isolate the cell from snout 75. A suitable theremoset plastic material is made from fabric or paper impregnated with phenol-formaldehyde resin, for instance the material supplied under the trademark Micarta by Westinghouse Electric Corp.

While gaskets 79 and 81 are simple asbestos-based gaskets, gasket 86 is constructed, according to the present invention, of two sheets of polytetrafluoroethylene with an interposed sheet of the asbestos-based material used for gaskets 79 and 81, this sandwich structure being cut in an annular shape. As will be apparent from the drawing, gasket 86 extends inwards from the surface formed by pipe sections 38b and 88 such that the gap between the inner periphery of gasket 86 and the outer periphery of tube 74 is not more than one-sixteenth-inch. For example, with gasket 86 and tube 74 being circular, the inner diameter of gasket 86 is up to one-eighth-inch greater than the outer diameter of tube 74. Gasket 86 is thus in effect in the form of a protrusion with its outer annular portion clamped and its inner annular portion protruding radially inwards into free space. The amount of this protrusion, the length of the protrusion, is at least one-fourth-inch (one-half-inch on a diameter basis), preferably at least one-half-inch, more preferably at least one inch. The polytetrafluoroethylene surfaces are not wet by condensed vapors from the molten bath. Consequently, this protruded gasket forms a barrier to prevent a continuous film of condensate which could otherwise short circuit the lid 16 (which usually becomes anodic) with the molten aluminum (at cathode potential) in snout 75. It is because gasket 86 is relatively expensive and must be made, and secured in place, just right so as to preclude short circuiting, that ring 80 is provided. In this way, the snout can be removed, for example for replacement of quartz tube 40, without disturbing the previous securement of gasket 86.

The packing tube 74 is made of a chlorine resistant alloy, for example the above-mentioned alloy sold under the trademark Inconel. The pipe section 88, in the form of a facing on ring 80, may be made of the same material.

The entire tapping assembly is put in place before the cell is started up. The quartz tube protrudes into the sump (not shown) of the cell. In tapping, a vacuum is drawn in a molten metal holding vessel (not shown) connected to snout 75, and this causes metal to be sucked out of the sump of the cell, up through tube 40, through snout 75, and into the metal holding vessel.

As will be apparent from FIG. 1, the pressure within the region enclosed by pipe section **38*b* is the same as the pressure within the region enclosed by pipe section 88, i.e., the pressure on either side of gasket 86** is the same.

Further illustrative of the present invention is the following example:

The remainder of the cell was constructed as a 12 compartment bipolar cell (i.e. an anode, a cathode and 11 bipolar electrodes) and then filled with an average molten salt bath of the following composition in weight percent:

| | |
|---|---|
| NaCl | 51.0 |
| LiCl | 40.0 |
| $AlCl_3$ | 6.5 |
| $MgCl_2$ | 2.5 |

Electrolysis to produce molten aluminum and chlorine was carried out with 31 volts across the cell and an average temperature of 715° C. During electrolysis, the coolant circulated through jacket 14 was at a temperature and volume flow rate such that the surface of lid 16 facing the bath was brought to the neighborhood of 120° F. Bath constituents which had e.g. evaporated from the bath deposited as a film of molten salt on the lid 16 and on the inner surfaces of metal parts **38*b* and 88. Gasket 86 protruded inwards 1½ inches (3 inches on a diameter basis) and effectively prevented short circuiting where previous experience with use of a gasket of the same sandwich design but not protruding inwards into free space past the surface formed by pipe sections 38*b* and 88** had resulted in the molten salt film's creating a short circuit.

It will be understood that the above description of the present invention is susceptible to various modifications, changes, and adaptations and the same are intended to be comprehended within the meaning and range of equivalents of the appended claims.

What is claimed is:

1. The method of preventing the conduction of electricity along a film of molten salt on a surface, comprising interposing an electrically insulating material which is not wet by the molten salt, said material being in the form of a protrusion on said surface.

2. The method as claimed in claim 1 wherein the length of the protrusion is at least 1/4 inch.

3. The method as claimed in claim 1 wherein the length of the protrusion is at least 1/2 inch.

4. The method as claimed in claim 1 wherein the length of the protrusion is at least 1 inch.

5. The method including producing metal by electrolysis in a molten salt bath, where portions of the molten salt bath condense in the form of a liquid film on a surface above the bath and wherein the improvement comprises interposing in said film an electrically insulating material which is not wet by the film, said material being in the form of a protrusion on said surface.

6. The method as claimed in claim 5 wherein molten metal is tapped through a port in said surface and said material is provided as a barrier around said port.

7. The method of preventing the conduction of electricity along the length of a pipe by a film of molten salt on the interior of the pipe comprising providing a protrusion of electrically insulating material which is not wet by the molten salt, completely around the interior of the pipe.

8. The method as claimed in claim 7 wherein the pipe is metal and the step of providing is effected by breaking the length of the pipe into two abutting sections and clamping between these sections an annular gasket of said material, the inner dimensions of the gasket being less than the inner dimensions of the pipe sections, the gasket extending inwardly into free space completely around the interior of the pipe sections.

9. The method as claimed in claim 1, wherein the pressure is the same on either side of the protrusion.

10. The method as claimed in claim 5, wherein the pressure is the same on either side of the protrusion.

11. The method as claimed in claim 7, wherein the pressure is the same on either side of the protrusion.

* * * * *